US008371150B2

(12) United States Patent
Hu et al.

(10) Patent No.: US 8,371,150 B2
(45) Date of Patent: Feb. 12, 2013

(54) FORMING DIE

(75) Inventors: Sen-hsiung Hu, Tu Cheng (TW); Dong-hua Tan, Tu Cheng (TW); Yong-ping Wu, Tu Cheng (TW)

(73) Assignee: Cheng Uei Precision Industry Co., Ltd., Tu Cheng, Taipei (TW)

( * ) Notice: Subject to any disclaimer, the term of this patent is extended or adjusted under 35 U.S.C. 154(b) by 324 days.

(21) Appl. No.: 12/942,849

(22) Filed: Nov. 9, 2010

(65) Prior Publication Data

US 2012/0111086 A1 May 10, 2012

(51) Int. Cl.
*B21D 37/14* (2006.01)

(52) U.S. Cl. ..... 72/475; 72/386; 72/452.9

(58) Field of Classification Search ..... 72/381, 72/452.1, 452.8, 452.9, 470, 472, 474, 475, 72/389.1, 389.2, 390.3, 393, 392, 399–401, 72/403, 296, 306, 380, 386, 312–315, 322, 72/319

See application file for complete search history.

(56) References Cited

U.S. PATENT DOCUMENTS

| | | | | |
|---|---|---|---|---|
| 5,802,906 | A * | 9/1998 | Lillbacka et al. | 72/294 |
| 6,755,070 | B2 * | 6/2004 | Jung | 72/452.9 |
| 7,191,635 | B2 * | 3/2007 | Chun et al. | 72/452.9 |
| 7,665,341 | B2 * | 2/2010 | Kinoshita | 72/381 |

FOREIGN PATENT DOCUMENTS

WO WO 9316822 A1 * 9/1993

* cited by examiner

*Primary Examiner* — Dana Ross
*Assistant Examiner* — Pradeep C Battula
(74) *Attorney, Agent, or Firm* — Cheng-Ju Chiang

(57) ABSTRACT

Provided is a forming die, including a movable supporting member, a movable die, a fixed supporting member and a fixed die. The movable supporting member disposes an oblique sliding groove. The movable die disposes an oblique guiding surface engaged with the oblique sliding groove. The movable die disposes a forming portion, which includes a forming base and a protruding portion extending downward from the forming base. The movable die can tilted move along the oblique sliding groove. The fixed die disposes a flange having a high point. The forming die of the present invention employs the movable die tilted moving along the oblique sliding groove to make the protruding portion extend into the back space of the high point, so that no gap exists between a bending portion of a terminal and the flange for obtaining the bending portion having a large bending degree and having a stable size.

3 Claims, 4 Drawing Sheets

FORMING DIE

BACKGROUND OF THE INVENTION

1. Field of the Invention

The present invention relates to a forming die, and more particularly to a forming die for bending metal parts.

2. Description of the Prior Art

Please refer to FIGS. 5 and 6, a forming die 100' of prior art comprises a moving die 1', a moving supporting member 2', a fixed die 3' and a fixed supporting member 4'. The moving die 1' is fixed on the moving supporting member 2', and the fixed die 3' is fixed on the fixed supporting member 4'. The moving die 1' disposes a protruding portion 11' on the left side thereof. The protruding portion 11' disposes a forming portion 12'. The fixed die 3' defines a receiving cavity 31'. A flange 32' is formed on the bottom wall of the receiving cavity 31' and is capable of being engaged with the forming portion 12'. The flange 32' forms a high point 321'. In the forming process, one end of a terminal 5' is held between the fixed die 3' and the fixed supporting member 4', then the moving die 1' is driven to move toward the left so that the other end of the terminal 5' is bent to form a bending portion 51'.

However, because the prior forming die 100' horizontally moves relative to the fixed die 3', a front end 13' of the forming portion 12' cannot touch a back portion 322' on the back of the high point 321' of the flange 32' and cannot completely extrude the bending portion 51' of the terminal 5'. Namely, a gap 33' is existed between the bending portion 51' of the terminal 5' and the flange 32' of the fixed die 3', so the extrusion force bearing area of the terminal 5' is reduced and the size of the bending portion 51' obtained by the prior forming die 100' is not stable. Therefore, the bending degree of the bending portion 51' obtained by the prior forming die 100' is not enough to satisfy the needs for manufacturing.

BRIEF SUMMARY OF THE INVENTION

An object of the present invention is to provide a forming die, being capable of making the formed product have a large bending degree and have a stable size.

To achieve the above object, in accordance with the present invention, a forming die is provided, comprising a movable supporting member, at least one movable die, a fixed supporting member and a fixed die engaged with the movable die. The movable supporting member disposes at least one oblique sliding groove. One end of the movable die disposes an oblique guiding surface engaged with the oblique sliding groove of the movable supporting member. The movable die is received in the oblique sliding groove. The movable die disposes a forming portion, which includes a forming base and a protruding portion extending downward from the forming base. The movable die is capable of tilted moving along the oblique sliding groove. The fixed die is mounted on the fixed supporting member. The fixed die disposes a flange engaged with the forming base of the forming portion. The flange has a high point. The protruding portion is capable of entering into a back space on the back of the high point of the flange.

Based on the above description, the forming die of the present invention employs the movable die, which is capable of tilted moving along the oblique sliding groove and disposes the protruding portion, to make the protruding portion extend into the back space of the high point of the flange of the fixed die, so that increasing the extrusion force bearing area of the terminal. No gap exists between the bending portion of the terminal and the flange for obtaining the bending portion having a large bending degree and having a stable size.

DETAILED DESCRIPTION OF THE PREFERRED EMBODIMENTS

The following embodiment with reference to the accompanying drawings now has been given for detail describing the technology, the feature, the object and the effect of the present invention.

Figure 1:
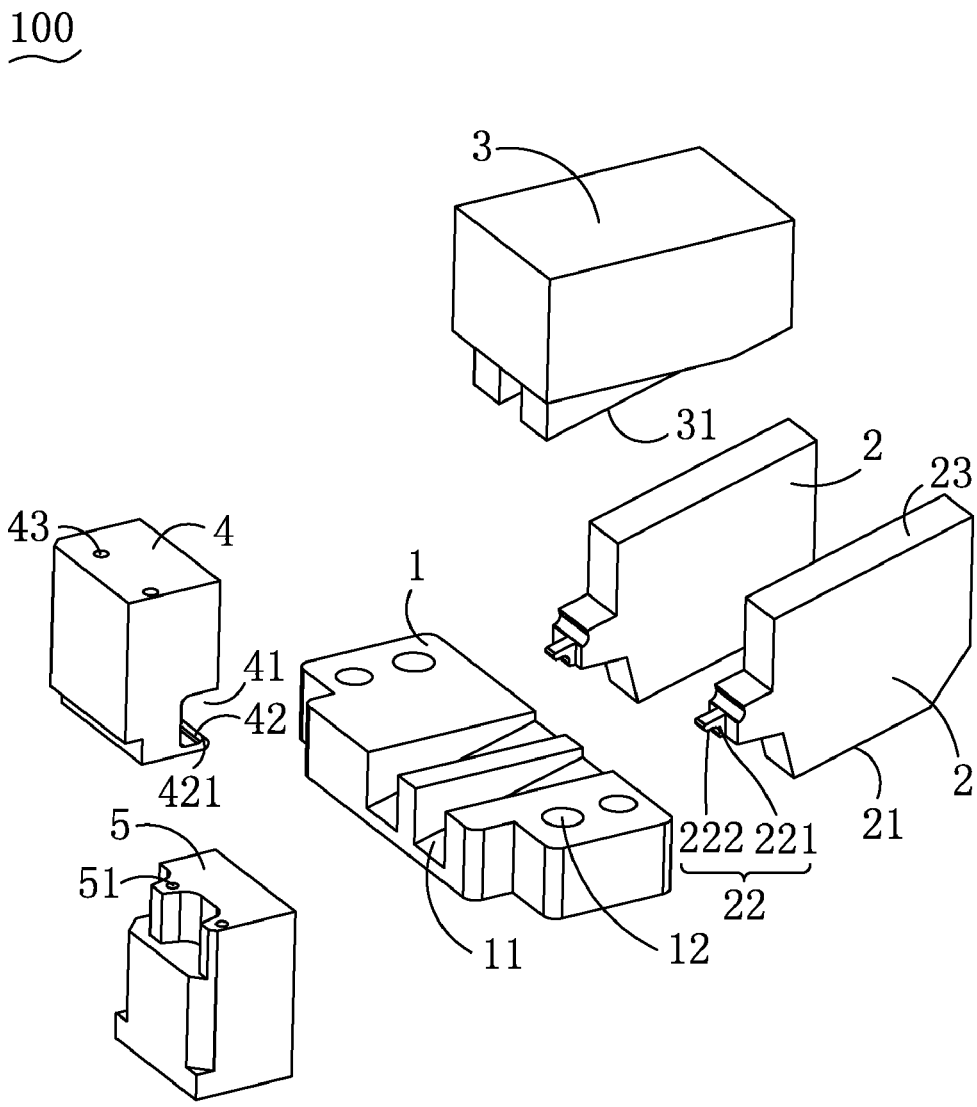
FIG. 1 is an exploded perspective view of a forming die according to one embodiment of the present invention.

Referring to FIG. 1, a forming die 100 of the present invention comprises a movable supporting member 1, two movable dies 2, a pressure block 3, a fixed die 4 matched with the two movable dies 2, and a fixed supporting member 5.

Figure 2:
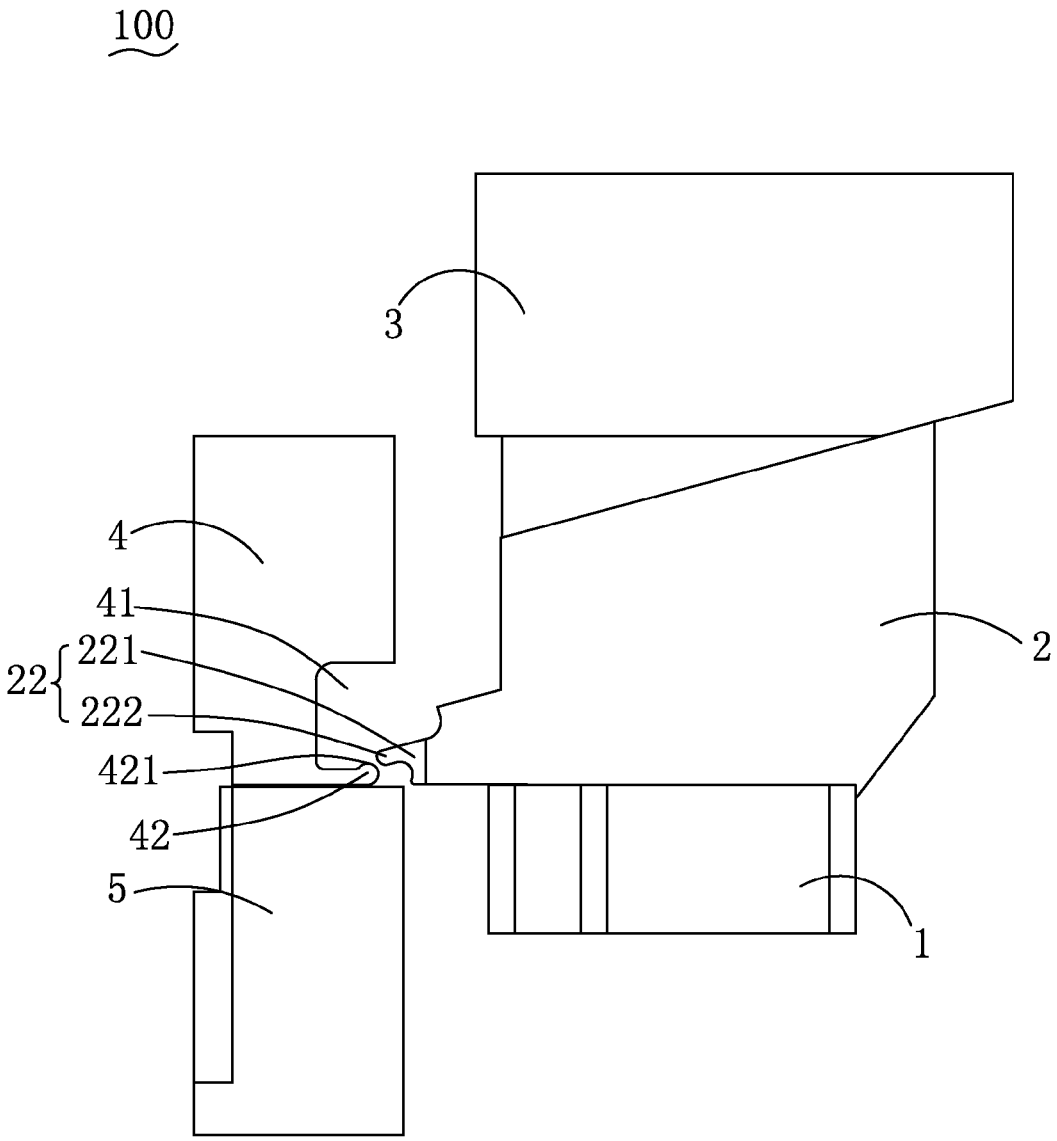
FIG. 2 is a side view of the forming die of FIG. 1.

Referring to FIGS. 1 and 2, the movable supporting member 1 disposes two oblique sliding grooves 11 and a plurality of through holes 12. The movable supporting member 1 employs connecting members such as bolts to pass through the through holes 12 for being fixed on a forming machine (not shown in all FIGS). Each movable die 2 disposes an oblique guiding surface 21 on a lower end thereof, which is engaged with the corresponding oblique sliding groove 11 of the movable supporting member 1. Each movable die 2 disposes an oblique surface 23 on an upper end thereof. Each movable die 2 disposes a forming portion 22, which includes a forming base 221 and a protruding portion 222 extending downward from the forming base 221. The lower end of the movable dies 2 is received in the oblique sliding groove 11 and can tilted move along the oblique sliding groove 11. The pressure block 3 disposes two oblique surfaces 31 separately engaged with the oblique surfaces 23 of the two movable dies 2. The pressure block 3 is placed on the oblique surfaces 23 of the two movable dies 2 to tightly press the two movable dies 2, so that avoiding that the two movable dies 2 leave the inner surface of the oblique sliding grooves 11 during moving along the oblique sliding groove 11.

The fixed die 4 disposes a receiving cavity 41, on a bottom wall of which a flange 42 is formed. The flange 42 is engaged with the forming base 221 and has a high point 421. The fixed die 4 disposes a plurality of through holes 43. The fixed supporting member 5 also disposes a plurality of through holes 51. The fixed die 4 is mounted on the fixed supporting member 5.

Figure 3:
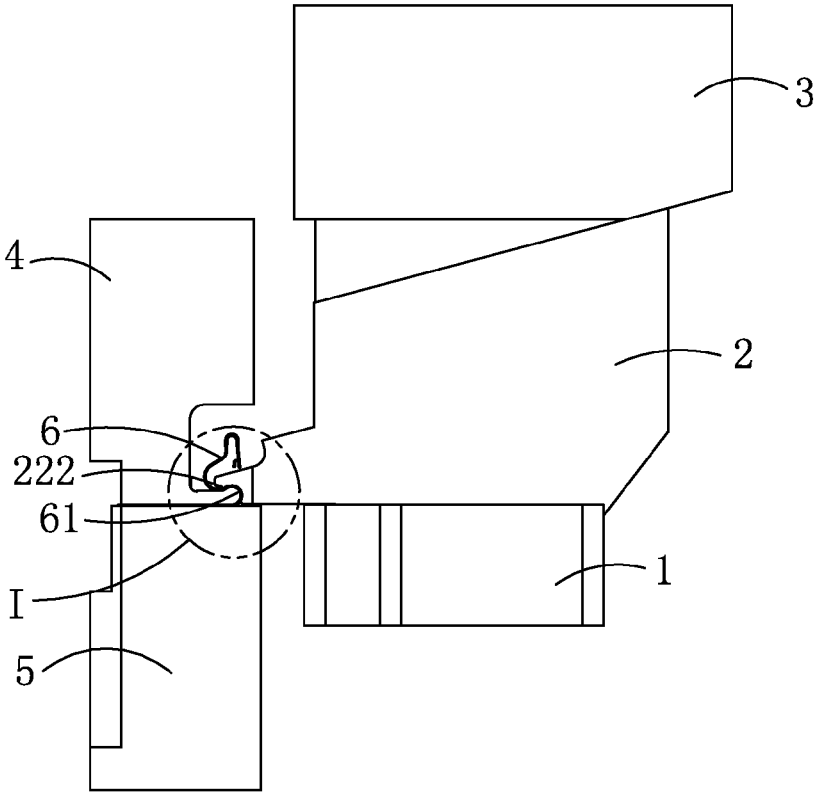
FIG. 3 is showing that the forming die of FIG. 2 is used to form a bending portion of a terminal.
Figure 4:
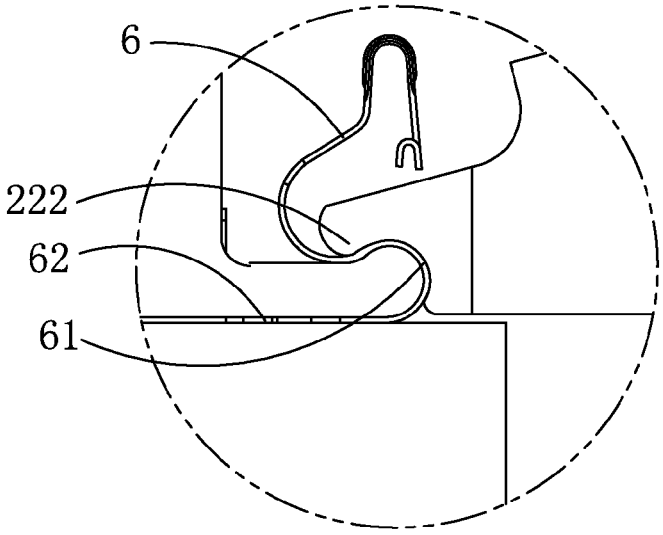
FIG. 4 is an enlarged view of part I in FIG. 3.
Figure 5:
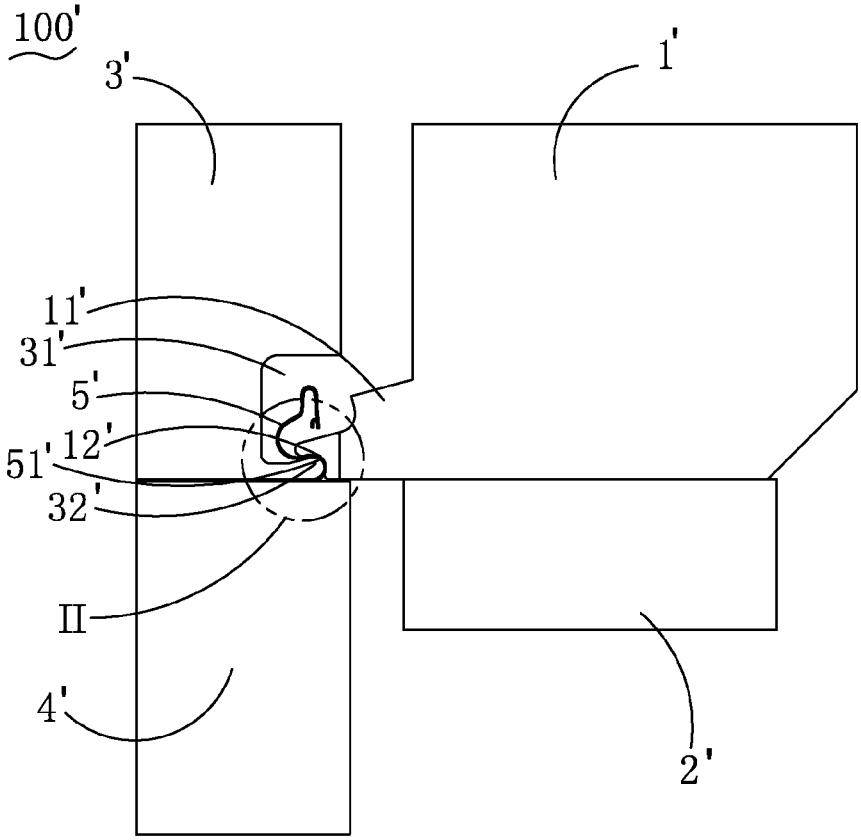
FIG. 5 (PRIOR ART)
FIG. 5 is a side view of a forming die of prior art, which is forming a bending portion of a terminal.
Figure 6:
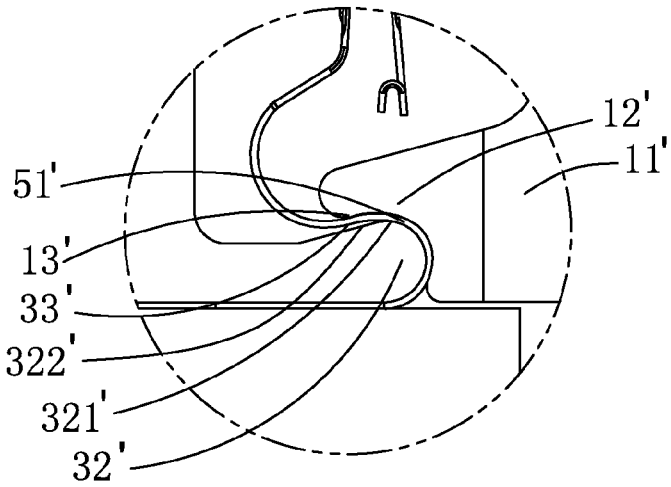
FIG. 6 (PRIOR ART)
FIG. 6 is an enlarged view of part II in FIG. 5.

Referring to FIGS. 2 to 4, when forming a terminal 6, first, a fixed end 62 of the terminal 6 is placed between the fixed die 4 and the fixed supporting member 5. Then, the fixed die 4 and the fixed supporting member 5 can tightly clip the terminal 6 by employing the connecting members such bolts to pass through the through holes 43, 51. Next, by pushing the movable die 2, the movable die 2 can move toward the lower left along the oblique sliding grooves 11 of the movable supporting member 1 to extrude the terminal 6, thereby forming a bending portion 61 on the terminal 6. Because the protruding portion 222 of the movable die 2 is capable of entering into a back space on the back of the high point 421 of the flange 42 of the fixed die 4, the extrusion force bearing area of the terminal 6 is increased and no gap exists between the bending portion 61 of the terminal 6 and the flange 42, thereby obtaining the bending portion 61 having a large bending degree.

As described above, the forming die 100 of the present invention employs the movable die 2, which is capable of tilted moving along the oblique sliding groove 11 and disposes the protruding portion 222, to make the protruding portion 222 extend into the back space of the high point 421 of the flange 42 of the fixed die 4, so that increasing the extrusion force bearing area of the terminal 6. No gap exists between the bending portion 61 of the terminal 6 and the flange 42 for obtaining the bending portion 61 having a large bending degree and having a stable size.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A forming die comprising:

a movable supporting member, disposing at least one oblique sliding groove;

at least one movable die, being received in the oblique sliding groove, and disposing a forming portion that includes a forming base and a protruding portion extending downward from the forming base, wherein one end of the movable die disposes an oblique guiding surface engaged with the oblique sliding groove of the movable supporting member, and the movable die is capable of tilted moving along the oblique sliding groove;

a fixed die, corresponding to the movable die and disposing a flange engaged with the forming base of the forming portion, wherein the flange has a high point, and the protruding portion is capable of entering into a back space on the back of the high point of the flange; and a fixed supporting member, on which the fixed die being mounted.

2. The forming die as claimed in claim 1, further comprising a pressure block, wherein the other end of the movable die disposes an oblique surface opposite to the oblique guiding surface, the pressure block disposes an oblique surface engaged with the oblique surface of the movable die, and the oblique surface of the pressure block is placed on the oblique surface of the movable die.

3. The forming die as claimed in claim 1, wherein the fixed die disposes a receiving cavity, and the flange is disposed on one wall of the receiving cavity.

* * * * *